US009599968B2

(12) United States Patent
Kato et al.

(10) Patent No.: US 9,599,968 B2
(45) Date of Patent: Mar. 21, 2017

(54) SATELLITE RADIO-CONTROLLED WRISTWATCH

(71) Applicants: CITIZEN HOLDINGS CO., LTD., Tokyo (JP); CITIZEN WATCH CO., LTD., Tokyo (JP)

(72) Inventors: Akira Kato, Sayama (JP); Ken Kitamura, Nishitokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/413,702

(22) PCT Filed: Jul. 10, 2013

(86) PCT No.: PCT/JP2013/068906
§ 371 (c)(1),
(2) Date: Jan. 9, 2015

(87) PCT Pub. No.: WO2014/010643
PCT Pub. Date: Jan. 16, 2014

(65) Prior Publication Data

US 2015/0192904 A1 Jul. 9, 2015

(30) Foreign Application Priority Data

Jul. 11, 2012 (JP) ..... 2012-155971

(51) Int. Cl.
*G04R 20/04* (2013.01)
*G04R 20/06* (2013.01)
*G04R 60/14* (2013.01)

(52) U.S. Cl.
CPC ..... *G04R 20/06* (2013.01); *G04R 20/04* (2013.01); *G04R 60/14* (2013.01)

(58) Field of Classification Search
CPC ..... G04R 20/04; G04R 20/06; G04R 60/14
See application file for complete search history.

(56) References Cited

U.S. PATENT DOCUMENTS 6,212,133 B1 * 4/2001 McCoy ..... G01S 19/34 342/357.43
7,920,441 B2 * 4/2011 Rostrom ..... G01S 19/24 368/14

(Continued)

FOREIGN PATENT DOCUMENTS

CN 101118414 A 2/2008
CN 101344759 A 1/2009

(Continued)

OTHER PUBLICATIONS

Office Action for relating U.S. Appl. No. 14/413,703 dated Jul. 8, 2015.

(Continued)

*Primary Examiner* — Vit W Miska
(74) *Attorney, Agent, or Firm* — Hubbs, Enatsky & Inoue PLLC

(57) ABSTRACT

In a satellite radio-controlled wristwatch, processing ranging from a user's operation through a reception operation to the completion of time adjustment is rapidly accomplished. The satellite radio-controlled wristwatch according to the present invention includes: a satellite radio wave reception unit including an antenna, a high frequency circuit, and a decoder circuit; an analog indication member for indicating at least that a reception operation is in process and a reception result; a clock circuit for holding and counting an internal time; an operating member for receiving an operation of a user; and a controller for controlling timings of at least: an activation operation of activating the satellite radio wave reception unit; an acquisition and tracking operation of acquiring and tracking a certain satellite radio wave; a time information acquisition operation of acquiring time information from the satellite radio wave; a continuous operation detection operation of detecting that the operating member is operated continuously; and a reception indication movement opera- (Continued)

tion of moving the analog indication member to a position indicating that the reception operation is in progress, the controller being configured to carry out such control that the reception indication movement operation overlaps with at least one of the activation operation or the acquisition and tracking operation.

8 Claims, 14 Drawing Sheets

(56) References Cited

U.S. PATENT DOCUMENTS

| | | | | |
|---|---|---|---|---|
| 7,983,116 | B2 * | 7/2011 | Fujisawa | G01S 19/14 368/46 |
| 8,169,857 | B2 * | 5/2012 | Matsuzaki | G04R 20/04 342/357.63 |
| 8,188,916 | B2 * | 5/2012 | Shingyoji | G01S 19/24 342/357.63 |
| 2003/0187575 | A1 | 10/2003 | King | |
| 2006/0067166 | A1 | 3/2006 | Murata | |
| 2008/0025151 | A1 | 1/2008 | Urano et al. | |
| 2008/0175105 | A1 | 7/2008 | Urano et al. | |
| 2008/0239880 | A1 | 10/2008 | Murata | |
| 2009/0015470 | A1 | 1/2009 | Fujisawa | |
| 2009/0034371 | A1 | 2/2009 | Matsuzaki | |
| 2009/0034372 | A1 | 2/2009 | Fujisawa | |
| 2009/0079630 | A1 * | 3/2009 | Baba | G01S 19/14 342/357.52 |
| 2009/0135674 | A1 * | 5/2009 | Matsuzaki | G01S 19/14 368/14 |
| 2009/0189809 | A1 * | 7/2009 | Baba | G01S 1/047 342/357.57 |
| 2010/0054087 | A1 | 3/2010 | Matsuzaki | |
| 2010/0214165 | A1 | 8/2010 | Baba | |
| 2012/0051191 | A1 | 3/2012 | Fujisawa | |
| 2012/0176868 | A1 | 7/2012 | Matsuzaki | |
| 2012/0295563 | A1 | 11/2012 | Baba | |
| 2013/0009816 | A1 | 1/2013 | Hagita | |

FOREIGN PATENT DOCUMENTS

| | | | |
|---|---|---|---|
| CN | 101359216 | A | 2/2009 |
| CN | 101359218 | A | 2/2009 |
| CN | 101498780 | A | 8/2009 |
| CN | 101813781 | A | 8/2010 |
| CN | 102289195 | A | 12/2011 |
| EP | 2023221 | A2 | 2/2009 |
| EP | 2093634 | A2 | 8/2009 |
| EP | 2228664 | A1 | 9/2010 |
| JP | 2006-162329 | A | 6/2006 |
| JP | 2009-053182 | A | 3/2009 |
| JP | 2009-180555 | A | 8/2009 |
| JP | 2010-060456 | A | 3/2010 |
| JP | 2011-043449 | A | 3/2011 |
| JP | 2011-145122 | A | 7/2011 |
| JP | 2011-208948 | A | 10/2011 |
| JP | 2011-208950 | A | 10/2011 |
| JP | 2011-226813 | A | 11/2011 |
| JP | 2012-093281 | A | 5/2012 |

OTHER PUBLICATIONS

International Search Report for PCT/JP2013/068906 dated Aug. 20, 2013.

The Quayle Action for U.S. Appl. No. 14/413,709 dated May 4, 2015.

European Search Report dated May 19, 2016 for corresponding EP application No. 13816080.9.

Office Action dated Aug. 2, 2016 for relating CN application No. 201380037064.2. and the translation thereof.

Partial Translation of the Office Action for relating JP application No. 2014-524849 dated on Sep. 6, 2016.

* cited by examiner

FIG.4

SUBFRAME 1

| WORD | BIT POSITION | BIT COUNT | CONTENT | |
|---|---|---|---|---|
| 1 | 1 | 22 | TLM | TELEMETRY WORD |
| 2 | 31 | 22 | HOW | HANDOVER WORD |
| 3 | 61 | 10 | WN | WEEK NUMBER |
| | 73 | 4 | URA | RANGE ACCURACY |
| | 77 | 6 | SVhealth | SATELLITE HEALTH STATE |
| | 83 | 2 MSB | 10DC | CLOCK INFORMATION NUMBER |
| 7 | 197 | 8 | TGD | GROUP DELAY |
| 8 | 211 | 8 LSB | 10DC | CLOCK INFORMATION NUMBER |
| | 219 | 16 | toc | EPOCH TIME (CLOCK) |
| 9 | 241 | 8 | af2 | CLOCK CORRECTION COEFFICIENT |
| | 249 | 16 | af1 | CLOCK CORRECTION COEFFICIENT |
| 10 | 271 | 22 | af0 | CLOCK CORRECTION COEFFICIENT |

SATELLITE RADIO-CONTROLLED WRISTWATCH

CROSS REFERENCE TO RELATED APPLICATIONS

This application is a National Stage of International Application No. PCT/JP2013/068906filed Jul. 10, 2013, claiming priority based on Japanese Patent Application No. 2012-155971 filed on Jul. 11, 2012. The contents of each of the above documents are incorporated herein by reference in their entirety.

TECHNICAL FIELD

The present invention relates to a satellite radio-controlled wristwatch.

BACKGROUND ART

There has been proposed a radio-controlled wristwatch (hereinafter referred to as "satellite radio-controlled wristwatch") configured to receive a radio wave (hereinafter referred to as "satellite radio wave") from an artificial satellite used for a positioning system, such as a Global Positioning System (GPS) satellite, to thereby adjust time. Such adjustment is possible because positioning signals typified by a GPS signal contain accurate time information. An ultra-high frequency wave is used for such a satellite radio wave, and hence a larger amount of information is sent per hour as compared to a low frequency wave used for a standard radio wave, which has been used in the related art for time adjustment on the ground. As a result, the time required for reception of the time information is considered to be reduced as compared to the case where the standard radio wave is received.

In Patent Literature 1, there is disclosed a GPS-equipped wristwatch corresponding to the satellite radio-controlled wristwatch. As described in paragraph 0040 in the literature, the GPS-equipped wristwatch disclosed therein carries out reception processing when a button is pressed for several seconds, for example, three seconds or more. When the reception is in progress in a time measuring mode, the second hand moves to the position of symbol "Time". When GPS satellite acquisition has failed, the secondhand moves to the position of symbol "N".

CITATION LISA

Patent Literature

[Patent Literature 1] JP 2011-43449 A

SUMMARY OF INVENTION

Technical Problem

When the satellite radio-controlled wristwatch receives a satellite radio wave, in some cases, the satellite radio-controlled wristwatch indicates, to a user as needed, information relating to the reception operation such as indication that the reception operation is in progress or the result of success or failure in reception. When an analog indication member (which herein means a member for visually indicating information through mechanical change of a position or attitude) is used for this indication as typified by the second hand of the GPS-equipped wristwatch disclosed in Patent Literature 1 described above, the operation of the analog indication member itself takes a little time. Further, a predetermined time period is necessary even for a button pressing reception time period for starting the reception processing.

In the satellite radio-controlled wristwatch, as described above, the time required for reception of the time information is reduced, and hence it is thought that rapid accomplishment of processing ranging from the user's operation through the reception operation to the completion of the time adjustment significantly affects the commercial value of the wristwatch. However, no sufficient discussion has been made so far on the configuration for reducing the time required for the series of operations from the user's operation to the completion of the time adjustment.

The present invention has been made in view of the above-mentioned circumstances, and has an object to rapidly accomplish processing ranging from the user's operation through the reception operation to the completion of the time adjustment in the satellite radio-controlled wristwatch.

Solution to Problem

The invention disclosed in this application to achieve the above-mentioned object has various aspects, and the representative aspects are outlined as follows.

(1) A satellite radio-controlled wristwatch, including: a satellite radio wave reception unit including an antenna for receiving a satellite radio wave, a high frequency circuit, and a decoder circuit; an analog indication member for indicating at least that a reception operation is in process, and for indicating a reception result; a clock circuit for holding and counting an internal time; an operating member for receiving an operation of a user; and a controller for controlling timing of at least: an activation operation of supplying power to the satellite radio wave reception unit for activation thereof; an acquisition and tracking operation of acquiring and tracking a certain satellite radio wave by the satellite radio wave reception unit; a time information acquisition operation of acquiring time information from the satellite radio wave received by the satellite radio wave reception unit; a continuous operation detection operation which detects if operating member is operated continuously for a predetermined operation reception time period; and a reception indication movement operation of moving the analog indication member to a position indicating that the reception operation is in progress, the controller being configured to carry out such control that the reception indication movement operation overlaps with at least one of the activation operation or the acquisition and tracking operation.

(2) The satellite radio-controlled wristwatch according to claim 1, wherein the controller starts the activation operation during the continuous operation detection operation after the continuous operation detection operation is started.

(3) The satellite radio-controlled wristwatch according to Item (2), in which the controller starts the reception indication movement operation immediately after the continuous operation detection operation is ended, and starts the acquisition and tracking operation immediately after the activation operation is ended.

(4) The satellite radio-controlled wristwatch according to any one of claims 1 to 3, wherein the controller waits for arrival of the activation operation start time to start the activation operation when the operating member is operated at least the predetermined operation reception time period earlier than an activation operation start time that is a time point at which the activation operation is started, wherein the activation operation start time is inversely calculated from a time information acquisition operation start time that is a time point at which the time information acquisition operation is started, the time information acquisition operation start time being predicted based on the internal time, after the continuous operation detection operation is ended.

(5) The satellite radio-controlled wristwatch according to Item (4), in which the controller starts the reception indication movement operation immediately after the continuous operation detection operation is ended.

(6) The satellite radio-controlled wristwatch according to Item (4), in which the controller further controls a timing of a waiting indication movement operation of moving the analog indication member to a position indicating a waiting state, and in which the controller starts the waiting indication movement operation immediately after the continuous operation detection operation is ended, and then starts the reception indication movement operation.

(7) The satellite radio-controlled wristwatch according to anyone of Items (1) to (6), in which the controller further controls a timing of a date information acquisition operation of acquiring, from the satellite radio wave received by the satellite radio wave reception unit, date information that is information relating to date, and in which, when the date information is to be acquired, the controller starts the activation operation after waiting for arrival of an activation operation start time that is a time point at which the activation operation is started, which is inversely calculated from a date information acquisition operation start time that is a time point at which the date information acquisition operation is started, the date information acquisition operation start time being predicted based on the internal time.

(8) The satellite radio-controlled wristwatch according to anyone of Items (1) to (7), in which the controller further controls timings of: a time information transfer operation of transferring the acquired time information from the satellite radio wave reception unit to the clock circuit; and a reception result indication movement operation of moving the analog indication member to a position indicating the reception result, and in which the controller carries out such control that the time information transfer operation overlaps with the reception result indication movement operation.

(9) A satellite radio-controlled wristwatch, including: a satellite radio wave reception unit including an antenna for receiving a satellite radio wave, a high frequency circuit, and a decoder circuit; an indication member for indicating at least a reception result; a clock circuit for holding and counting an internal time; and a controller for controlling timings of at least: a time information acquisition operation of acquiring time information from the satellite radio wave received by the satellite radio wave reception unit; a time information transfer operation of transferring the acquired time information from the satellite radio wave reception unit to the clock circuit; and a reception result indication operation of causing the indication member to indicate the reception result, the controller being configured to carry out such control that the time information transfer operation overlaps with the reception result indication operation.

ADVANTAGEOUS EFFECTS OF INVENTION

According to the aspect of Item (1), (2), (3), (5), (6), (8), or (9), it is possible to rapidly accomplish processing ranging from the user's operation through the reception operation to the completion of the time adjustment in the satellite radio-controlled wristwatch.

Further, according to the aspect of Item (4) or (7), wasteful power consumption may be suppressed in the satellite radio-controlled wristwatch.

BRIEF DESCRIPTION OF DRAWINGS

FIG. 4 is a table showing the structure of subframe 1.

DESCRIPTION OF EMBODIMENTS

Figure 1:
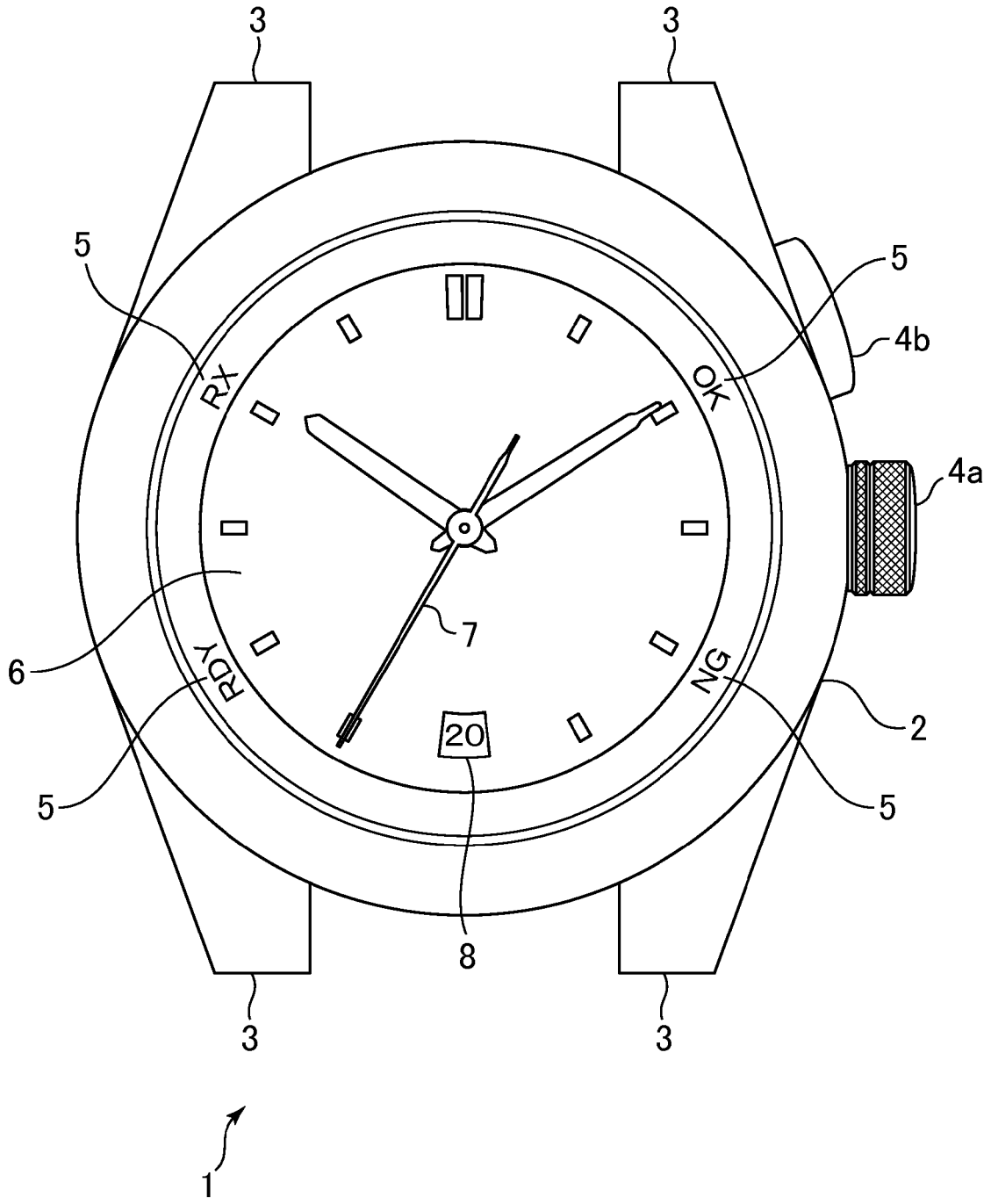
FIG. 1 is a plan view illustrating a satellite radio-controlled wristwatch according to a first embodiment of the present invention.

FIG. 1 is a plan view illustrating a satellite radio-controlled wristwatch 1 according to a first embodiment of the present invention. As described above, the satellite radio-controlled wristwatch as used herein refers to one type of radio-controlled wristwatches that are wristwatches having a function of receiving an external radio wave to adjust the time held inside the watch to an accurate time, which is configured to receive a satellite radio wave to adjust the time. Note that, the satellite radio-controlled wristwatch 1 according to this embodiment receives a radio wave (L1 wave) from a GPS satellite as the satellite radio wave.

In FIG. 1, reference numeral 2 denotes an exterior case, and band attachment portions 3 are provided to be opposed in the 12 o'clock direction and the 6 o'clock direction. Further, a crown 4*a* and a push button 4*b* serving as operating members are provided on a side surface of the satellite radio-controlled wristwatch 1 on the 3 o'clock side. Note that, in FIG. 1, the 12 o'clock direction of the satellite radio-controlled wristwatch 1 is an upward direction of FIG. 1, and the 6 o'clock direction is a downward direction of FIG. 1.

The satellite radio-controlled wristwatch 1 uses a hand mechanism as illustrated in FIG. 1, in which an hour hand, a minute hand, and a second hand are coaxially provided, with the central position of the satellite radio-controlled wristwatch 1 as the rotation center. Note that, although the second hand in this embodiment is coaxial with the hour and minute hands, the second hand may be replaced with a so-called chronograph hand and the second hand may be arranged at an arbitrary position as a secondary hand as exemplified by a chronograph watch. Then, position indications 5 of symbols "OK", "NG", "RDY", and "RX" are marked or printed on the exterior case 2 at appropriate positions outside a watch face 6. Those characters notify the user of various reception states of the satellite radio-controlled wristwatch 1 by causing the second hand to rotate and move to point to any one of those position indications 5 during or around the reception of the satellite radio wave by the satellite radio-controlled wristwatch 1. Therefore, the second hand is an analog indication member 7 for visually indicating information through mechanical change of a position or attitude (in this case, a rotational angle) thereof. Note that, the respective position indications 5 herein have the following meaning. That is, symbol "RX" means that the reception is in progress, symbol "RDY" means that the satellite radio-controlled wristwatch 1 is in a waiting state, symbol "OK" means that the reception has succeeded, and symbol "NG" means that the reception has failed.

Further, a date window 8 is provided at the 6 o'clock position of the watch face 6, and date can be visually recognized based on a position of a day dial shown through the date window 8. Note that, the date window 8 is merely an example and date display by an appropriate mechanism may be provided at an appropriate position. For example, in addition to the date display using the day dial or another rotating disk, day-of-week display and various kinds of indication using a secondary hand may be used. Alternatively, display by an electronic display device such as a liquid crystal display device may be used. In any case, the satellite radio-controlled wristwatch 1 internally holds at least information on the current date as well as the current time.

The satellite radio-controlled wristwatch 1 according to this embodiment further includes a patch antenna serving as a high frequency receiving antenna on the rear side of the watch face 6 at a position on the 9 o'clock side. Note that, the form of the antenna may be determined in accordance with the radio wave to be received, and an antenna of another form such as an inverted-F antenna may be used.

Figure 2:
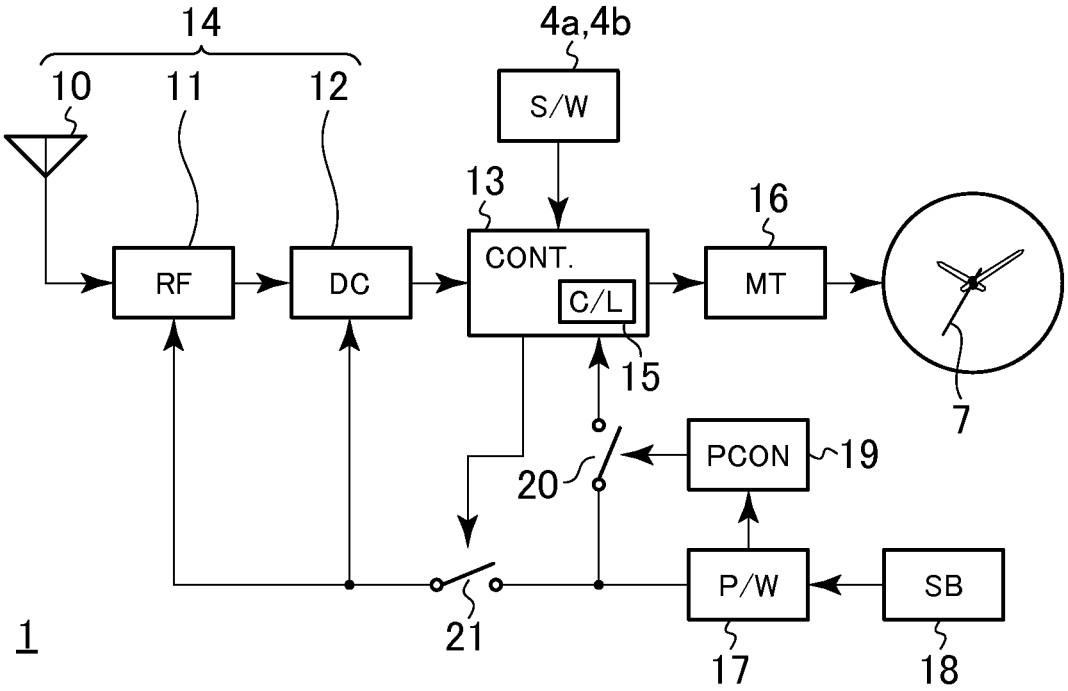
FIG. 2 is a functional block diagram of the satellite radio-controlled wristwatch according to the first embodiment of the present invention.

FIG. 2 is a functional block diagram of the satellite radio-controlled wristwatch 1 according to this embodiment. A satellite radio wave is received by an antenna 10 and converted into a base band signal by a high frequency circuit 11. After that, various kinds of information contained in the satellite radio wave is extracted by a decoder circuit 12. The extracted information is transferred to a controller 13. In this case, the antenna 10, the high frequency circuit 11, and the decoder circuit 12 construct a satellite radio wave reception unit 14 for receiving a satellite radio wave and extracting information. The satellite radio wave reception unit 14 receives the satellite radio wave that is an ultra-high frequency wave and extracts the information, and hence operates at a high frequency.

The controller 13 is a microcomputer for controlling the entire operation of the satellite radio-controlled wristwatch 1, and includes a clock circuit 15 therein, thereby having a function of counting the internal time, which is the time held by the clock circuit 15. The accuracy of the clock circuit 15 is about ±15 seconds per month although varying depending on the accuracy of a crystal oscillator to be used or the use environment such as temperature. It should be understood that the accuracy of the clock circuit 15 can be set arbitrarily as necessary. Further, the controller 13 appropriately adjusts the internal time held by the clock circuit 15 as necessary, to thereby keep the internal time accurate. The controller 13 is only required to have a response speed necessary for responding to counting and a user's operation. Therefore, the controller 13 operates at a lower frequency than that of the above-mentioned satellite radio wave reception unit 14, and hence its power consumption is small.

The controller 13 inputs a signal from the operating member (crown 4*a*, push button 4*b*, or the like) so that the operation by the user can be detected. Further, the controller 13 outputs a signal for driving a motor 16 based on the internal time, to thereby drive the hands to indicate the time. Further, necessary indication is given to the user by driving the analog indication member 7. As described above, in this embodiment, the analog indication member 7 is the second hand, for example, but the present invention is not limited thereto. Another hand or another member such as a disk may be used. For example, a dedicated hand for indication of various functions maybe used as the analog indication member. Alternatively, the respective hands may be independently driven so as to drive a plurality of hands, for example, the hour hand and the minute hand in an overlapped manner, thereby using the hands as the analog indication member. Still alternatively, the motion speed and the motion mode (intermittent drive, movement of the second hand at two-second intervals, or the like) of a hand may differ from those in normal hand motion, to thereby use the hand as the analog indication member.

The satellite radio-controlled wristwatch 1 further includes, as its power supply, a battery 17 that is a secondary battery such as a lithium-ion battery. The battery 17 accumulates electric power obtained by power generation of a solar battery 18 arranged on or under the watch face 6 (see FIG. 1). Then, the battery 17 supplies electric power to the high frequency circuit 11, the decoder circuit 12, and the controller 13.

A power supply circuit 19 monitors an output voltage of the battery 17. When the output voltage of the battery 17 decreases to be lower than a predetermined threshold, the power supply circuit 19 turns off a switch 20 to stop the supply of power to the controller 13. In response thereto, the supply of power to the clock circuit 15 is also stopped. Thus, when the switch 20 is turned off, the internal time held by the clock circuit 15 is lost. Further, when the output voltage of the battery 17 is recovered due to the power generation of the solar battery 18 or the like, the power supply circuit 19 turns on the switch 20 to supply power to the controller 13, to thereby recover the functions of the satellite radio-controlled wristwatch 1. Further, a switch 21 is a switch for turning on or off the supply of power to the high frequency circuit 11 and the decoder circuit 12, and is controlled by the controller 13. The high frequency circuit 11 and the decoder circuit 12, which operate at a high frequency, are large in power consumption, and hence the controller 13 turns on the switch 21 to operate the high frequency circuit 11 and the decoder circuit 12 only when the radio wave is received from the satellite, and otherwise turns off the switch 21 to reduce power consumption.

The satellite radio wave may be received when a request is issued from a user through operation of the operating member such as the crown 4*a* or the push button 4*b* (hereinafter referred to as "forced reception"), or when a predetermined time has come (hereinafter referred to as "regular reception"). Alternatively, the satellite radio wave may be received based on an elapsed time from the time at which the previous time adjustment was made, or based on information representing the generated energy of the solar battery 18 or other information representing an ambient environment of the satellite radio-controlled wristwatch 1 (hereinafter referred to as "environmental reception").

Subsequently, a description is given of a signal from a GPS satellite received by the radio-controlled wristwatch according to this embodiment. The signal transmitted from the GPS satellite has a carrier frequency of 1,575.42 MHz called "$L_1$ band". The signal is encoded by a C/A code specific to each GPS satellite modulated by binary phase shift keying (BPSK) at a period of 1.023 MHz, and is multiplexed by a so-called code division multiple access (CDMA) method. The C/A code itself has a 1,023-bit length, and message data on the signal changes every 20 C/A codes. In other words, 1-bit information is transmitted as a signal of 20 ms.

Figure 3:
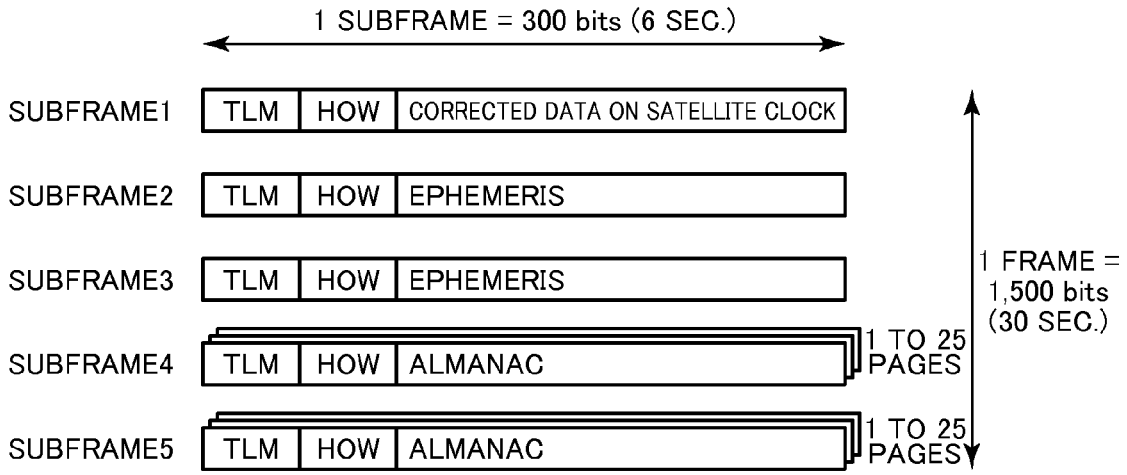
FIG. 3 is a schematic diagram illustrating the structure of subframes of a signal transmitted from a GPS satellite.

The signal transmitted from the GPS satellite is divided into frames having a unit of 1,500 bits, namely 30 seconds, and each frame is further divided into five subframes. FIG. 3 is a schematic diagram illustrating the structure of subframes of the signal transmitted from the GPS satellite. Each subframe is a signal of seconds containing 300-bit information. The subframes are numbered 1 to 5 in order. The GPS satellite transmits the subframes sequentially starting from subframe 1. When finishing the transmission of subframe 5, the GPS satellite returns to the transmission of subframe 1 again, and repeats the same process thereafter.

At the head of each subframe, a telemetry word represented by TLM is transmitted. TLM contains a preamble that is a code indicating the head of each subframe, and information on a ground control station. Subsequently, a handover word represented by HOW is transmitted. HOW contains TOW as information relating to the current time, also called "Z count". TOW is a 6-second-unit time counted from 0:00 AM on Sunday at GPS time, and indicates a time at which the next subframe is started.

Information following HOW differs depending on the subframe, and subframe 1 includes corrected data of a satellite clock. FIG. 4 is a table showing the structure of subframe 1. Subframe 1 includes a week number represented by WN following HOW. WN is a numerical value indicating a current week counted by assuming Jan. 6, 1980 as a week 0. Accordingly, by receiving both WN and TOW, accurate day and time at the GPS time can be obtained. Note that, once the reception of WN is succeeded, an accurate value can be known through counting of the internal time unless the radio-controlled wristwatch loses the internal time for some reason, for example, running out of the battery. Therefore, re-reception is not always necessary. Note that, as described above, WN is 10-bit information and hence is returned to 0 again when 1,024 weeks has elapsed. Further, the signal from the GPS satellite contains other various kinds of information, but information not directly relating to the present invention is merely shown and its description is omitted.

Referring to FIG. 3 again, subframe 2 and subframe 3 contain orbit information on each satellite called "ephemeris" following HOW, but its description is herein omitted.

In addition, subframes 4 and 5 contain general orbit information for all the GPS satellites called "almanac" following HOW. The information contained in subframes 4 and 5, which has a large information volume, is transmitted after being divided into units called "pages". Then, the data to be transmitted in each of subframes 4 and 5 is divided into pages 1 to 25, and contents of the pages that differ depending on the frames are transmitted in order. Accordingly, 25 frames, that is, 12.5 minutes is required to transmit the contents of all the pages.

Note that, as is apparent from the above description, TOW is contained in all the subframes and can therefore be acquired at a timing that arrives every 6 seconds. On the other hand, WN is contained in subframe 1 and can therefore be acquired at a timing that arrives every 30 seconds.

Subsequently, a series of operations to be executed by the satellite radio-controlled wristwatch 1 in the forced reception executed when the user operates the operating member is described with reference to FIGS. 1 and 2. All of those operations are controlled in execution timings by the controller 13.

(1) Continuous Operation Detection Operation

A continuous operation detection operation is an operation of detecting that the operating member has operated continuously for a predetermined operation reception time period. In the case of this embodiment, when the user carries out a long press operation of continuously pressing the push button **4*b*** for a predetermined time period (for example, 2 seconds, hereinafter referred to as "operation reception time period"), the forced reception is carried out. Continuous operation is required for the user so as to prevent unintended operation due to an operation error.

The continuous operation detection operation is carried out by the controller 13 by detecting that the push button **4*b*** has been pressed, and then detecting that the pressing has been continued for a predetermined time period.

(2) Activation Operation

An activation operation is an operation of turning on the switch 21 to supply power to the satellite radio wave reception unit 14 for activation thereof. This operation includes initialization of the high frequency circuit 11 and the decoder circuit 12 or the like, and takes a little time. The time point for ending the activation operation may be a time point at which a predetermined time period (for example, 0.6 seconds) has elapsed from the turning on of the switch 21 by the controller 13, or a time point at which the controller 13 has received a signal representing an activation end from the high frequency circuit 11 and the decoder circuit 12.

(3) Acquisition and Tracking Operation

An acquisition and tracking operation is an operation of acquiring and tracking a certain satellite radio wave by the satellite radio wave reception unit 14. The term "acquisition" herein refers to an operation of extracting one of the signals multiplexed by CDMA, specifically, an operation of multiplying a received signal by a C/A code corresponding to one signal to extract a correlated signal. When a correlated signal cannot be obtained by the selected C/A code, a different C/A code is selected again to repeat the operation. At this time, when there are a plurality of correlated signals, a signal having the highest correlation may be selected. Further, satellite position information maybe used to predict the satellite radio waves that may be received, to thereby limit the number of C/A codes to be selected and reduce the time required for the acquisition operation. Further, the term "tracking" herein refers to an operation of continuously extracting data by matching the phase of the carrier wave of the received signal and the phase of the C/A code contained in the received signal with the phase of the carrier wave of the selected C/A code and the phase of the code for decoding. Note that, it can be said from the meaning of the term "tracking" that the "tracking" is carried out while data is extracted from the satellite radio wave, but the "acquisition and tracking operation" herein refers to an operation from the start of acquiring the satellite radio wave to the head of TLM. This acquisition and tracking operation requires a time period of approximately 2 seconds.

(4) Time Information Acquisition Operation

A time information acquisition operation is an operation of acquiring time information from the satellite radio wave received by the satellite radio wave reception unit 14. In this embodiment, an operation of receiving TLM and HOW and acquiring TOW contained in HOW corresponds to the time information acquisition operation. This operation requires a time period for transmitting TLM and HOW, that is, 60 bits×20 ms=1.2 seconds. Note that, when the reception of the parity at the end of HOW is omitted, 47 bits×20 ms=0.94 seconds are required in the shortest.

(5) Date Information Acquisition Operation

A date information acquisition operation is an operation of acquiring date information that is information relating to the date from the satellite radio wave received by the satellite radio wave reception unit 14. The date information herein refers to information other than time information (that is, hour, minute, and second) and is information for specifying the date on a calendar. In the case of the GPS, WN corresponds to the date information. In this embodiment, an operation of receiving WN transmitted after TLM and HOW to acquire WN corresponds to the date information acquisition operation. Note that, TOW contained in HOW can be simultaneously acquired at this time. Therefore, in this embodiment, the date information acquisition operation also serves as the time information acquisition operation.

(6) Time Information Transfer Operation

A time information transfer operation is an operation of transferring the acquired time information from the satellite radio wave reception unit 14 to the clock circuit 15. As described above, the operation frequency of the satellite radio wave reception unit 14 differs from the operation frequency of the controller 13, and hence the decoded information cannot be directly transferred from the satellite radio wave reception unit 14 to the clock circuit 15. Therefore, the controller 13 once stores the decoded information, and extracts only the necessary time information or time and date information to transfer the information to the clock circuit 15 at an appropriate timing.

(7) Reception Indication Movement Operation

A reception indication movement operation is an operation of moving the analog indication member 7 to a position indicating that the reception operation is in progress. As described above, the analog indication member 7 (in this case, the second hand) visually indicates information through mechanical change of the position or attitude thereof, but such mechanical change of the position or attitude takes a certain time (for example, about 1 second). The user can know the current operation state of the satellite radio-controlled wristwatch 1 through the final position or attitude of the analog indication member 7. However, the fact that the satellite radio-controlled wristwatch 1 has started some kind of operation itself can be known through the start of the movement of the analog indication member 7.

(8) Waiting Indication Movement Operation

A waiting indication movement operation is an operation of moving the analog indication member 7 to a position indicating a waiting state. Note that, as described above, the timing of transmission of TOW or WN is fixed, and hence the satellite radio-controlled wristwatch 1 may need to wait for the transmission of TOW or WN. The "waiting state" means such a state, that is, a state in which the satellite radio-controlled wristwatch 1 is waiting for the transmission of TOW or WN.

(9) Reception Result Indication Movement Operation

A reception result indication movement operation is an operation of moving the analog indication member 7 to a position indicating the reception result. The reception result as used herein refers to any one of a case where the reception has succeeded and the internal time is adjusted (corresponding to "OK" indication) and a case where the reception has failed and the internal time is not adjusted (corresponding to "NG" indication).

(10) Previous Reception Result Indication Movement Operation

A previous reception result indication movement operation is an operation of moving the analog indication member 7 to a position indicating the previous reception result. The previous reception result as used herein refers to any one of a case where the previous reception has succeeded and the internal time has been adjusted (corresponding to "OK" indication) and a case where the previous reception has failed and the internal time has not been adjusted (corresponding to "NG" indication).

The controller 13 executes the above-mentioned respective operations while controlling the timings of the respective operations depending on the conditions when the user presses the push button 4*b*. Incidentally, as described above, the timing for receiving TOW, that is, a time information acquisition operation start time that is a time point at which the time information acquisition operation is started (which corresponds to a subframe transmission start time point, and hence matches with the timing of starting transmission of the preamble of the TLM head) arrives every 6 seconds. Therefore, if this time information acquisition operation start time is predictable, a time point can be obtained by subtracting time periods required for the acquisition and tracking operation and the activation operation, which are required to be executed before the time information acquisition operation, from the predicted time information acquisition operation start time (hereinafter this time point is referred to as "activation operation start time"). By starting the activation operation at this activation operation start time, the operation time of the satellite radio wave reception unit 14 can be minimized, which contributes to power saving.

Then, the controller 13 executes, based on various conditions and the timing at which the push button 4*b* is operated, the respective operations in the following time series.

<First Time Series>

This first time series is executed when the time information acquisition operation start time is predictable, and the timing at which the push button 4*b* is pressed is at least a predetermined preceding operation reception time period earlier than the activation operation start time and after a time point that is an operation reception time period earlier than the activation operation start time.

Figure 5A:
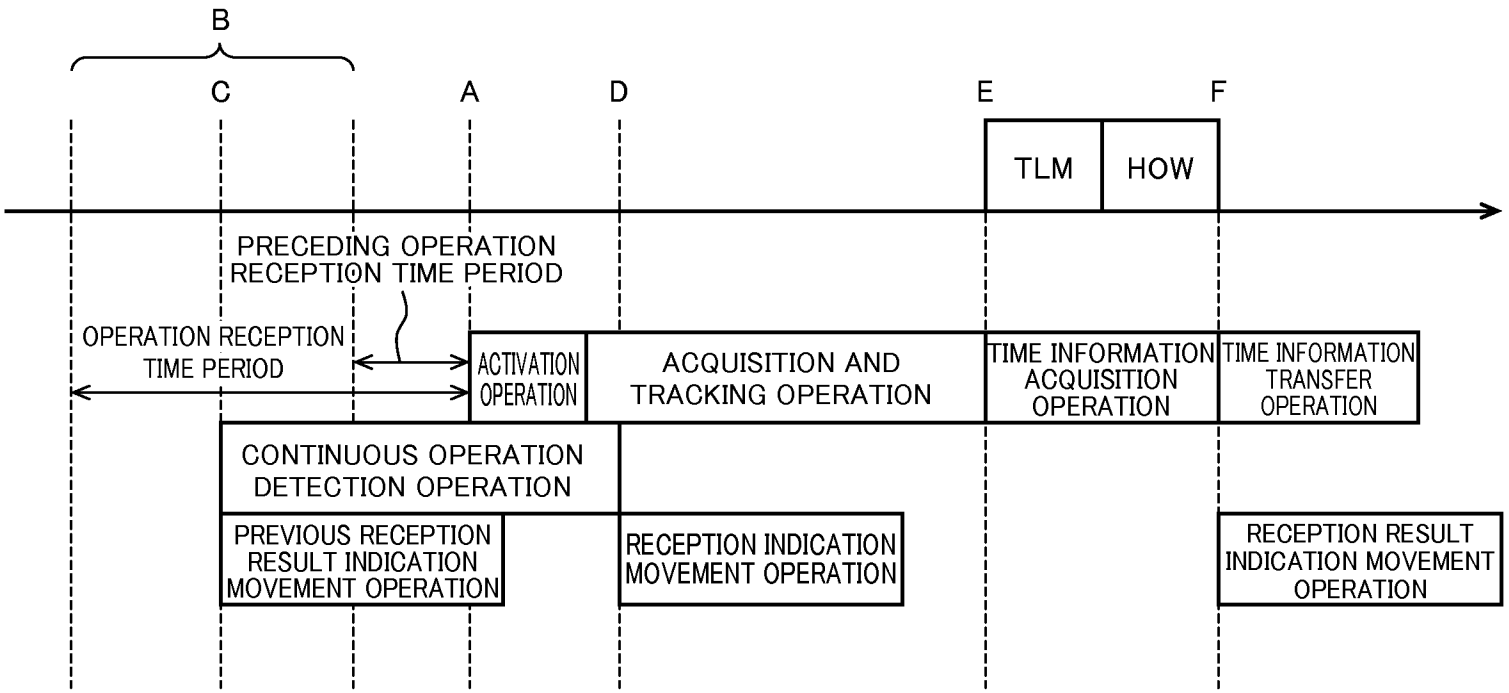
FIG. 5A is a time chart illustrating a first time series.

FIG. 5A is a time chart illustrating the first time series. In the chart, the horizontal axis represents the elapse of time. When the pushbutton 4*b* is pressed at a time point C during a period B that is at least a preceding operation reception time period earlier than an activation operation start time A that is a time point at which the activation operation is started and after a time point that is an operation reception time period earlier than the activation operation start time A, the controller 13 immediately starts the previous reception result indication movement operation to cause the analog indication member 7 to indicate the previous reception result. With this, in this embodiment, the second hand starts moving to point any one of the "OK" and "NG" indications. After that, the controller 13 waits for the arrival of the activation operation start time A to start the activation operation. As a result, the activation operation and the continuous operation detection operation are temporally overlapped with each other at least in part.

Now, the meaning of the preceding operation reception time period is described. If the operating member such as the push button 4*b* is operated continuously for a certain period of time, there is a high possibility that the operation of the operating member is continued as it is for the operation reception time period. In view of this, when the operation of the operating member is continued for a certain preceding operation reception time period (for example, 0.6 seconds) that is shorter than the operation reception time period, the activation operation is started earlier without waiting for the completion of the continuous operation detection operation. In this manner, the time required for the entire reception operation is reduced. Note that, when the operation of the operating member is interrupted before the continuous operation detection operation is completed, the controller 13 stops the activation operation or the acquisition and tracking operation, and cancels the entire reception operation.

Further, the controller 13 starts the reception indication movement operation at a time point D at which the continuous operation detection operation is completed, that is, after the push button 4*b* is pressed continuously for the operation reception time period. With this, in this embodiment, the second hand starts moving to point the "RX" indication. Further, the controller 13 starts the acquisition and tracking operation immediately after the activation operation is ended. As a result, the reception indication movement operation is temporally overlapped with at least one of the activation operation or the acquisition and tracking operation (in the illustrated example, the reception indication movement operation is overlapped with the acquisition and tracking operation). As described above, the activation operation and the acquisition and tracking operation are started without waiting for the analog indication member 7 to arrive at the position of the indication "OK" meaning that the reception is in progress. In this manner, the time required for the entire reception operation is reduced. Such an operation does not cause a significant problem because the user recognizes that the satellite radio-controlled wristwatch 1 has started some kind of operation (in this case, the reception of the satellite radio wave) at the time point at which the movement of the analog indication member 7 has started.

After that, the controller 13 starts the time information acquisition operation at a time information acquisition operation start time E to acquire TOW contained in HOW. Then, at a time point F, the controller 13 starts the time information transfer operation, and simultaneously carries out the reception result indication movement operation. With this, in this embodiment, without waiting for the end of transfer of the time information, at the time point F at which the time information acquisition operation is ended, the secondhand starts moving to point the "OK" or "NG" indication. As a result, the time information transfer operation and the reception result indication movement operation are temporally overlapped with each other, and thus the time required for the entire reception operation is reduced.

The reception operation based on the first time series described above is executed so that the continuous operation detection operation and the activation operation are temporally overlapped with each other, the reception indication movement operation and at least one of the activation operation or the acquisition and tracking operation are temporally overlapped with each other, and further the time information transfer operation and the reception result indication movement operation are temporally overlapped with each other. In this manner, the time required for the entire reception operation is reduced, and processing ranging from the user's operation through the reception operation to the completion of the time adjustment is rapidly accomplished.

<Second Time Series>

A second time series is executed when the time information acquisition operation start time is predictable, and the timing at which the push button 4*b* is pressed is at least an operation reception time period earlier than the activation operation start time. Note that, when this timing is after a time point that is a preceding operation reception time period earlier than the activation operation start time, the time acquisition is missed at the predicted time information acquisition operation start time. Therefore, the time information acquisition operation start time is postponed to the next timing (in the case of this embodiment, 6 seconds later), and the reception operation is subsequently executed based on the second time series.

Figure 5B:
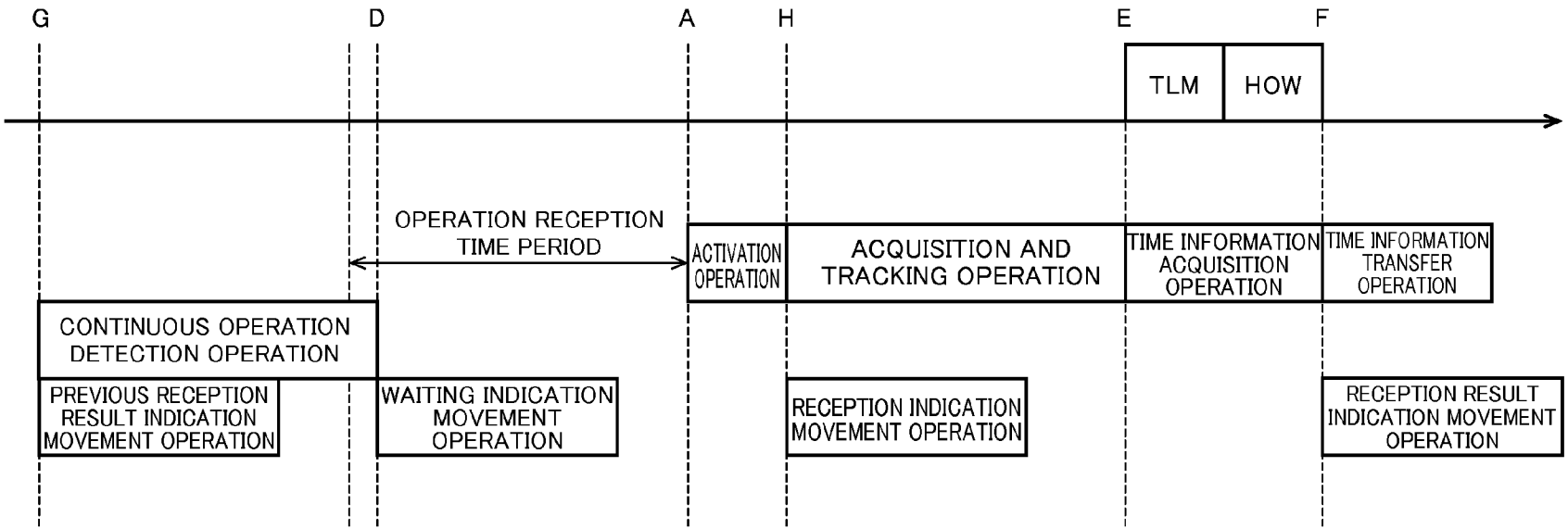
FIG. 5B is a time chart illustrating a second time series.

FIG. 5B is a time chart illustrating the second time series. Also in this chart, the horizontal axis represents the elapse of time. When the push button 4*b* is pressed at a time point G that is at least an operation reception time period earlier than the activation operation start time A that is a time point at which the activation operation is started, the controller 13 immediately starts the previous reception result indication movement operation to cause the analog indication member 7 to indicate the previous reception result.

In this case, at the time point D at which the continuous operation detection operation is completed, the activation operation start time A has not arrived yet . Therefore, the controller 13 starts the waiting indication movement operation at the time point D. In this embodiment, the second hand starts moving to point the "RDY" indication. During this period, power is not supplied to the satellite radio wave reception unit 14.

Subsequently, the controller 13 waits for the arrival of the activation operation start time A to start the activation operation. Further, at a time point H at which the activation operation is ended, the controller 13 starts the acquisition and tracking operation, and also starts the reception indication movement operation. Also in this case, the reception indication movement operation and the acquisition and tracking operation are temporally overlapped with each other. Note that, the time point at which the reception indication movement operation is started may be the activation operation start time A instead of the time point H at which the activation operation is ended. Alternatively, the time point at which the reception indication movement operation is ended may be the time point H at which the activation operation is ended. In this case, the time point at which the reception indication movement operation is started is inversely calculated by subtracting the time period required for the reception indication movement operation from the time point H at which the activation operation is ended. Subsequent operations are the same as those in the first time series.

In the reception operation based on the second time series described above, power is supplied to the satellite radio wave reception unit 14 only after waiting for the arrival of the activation operation start time A. Therefore, the operation times of the high frequency circuit 11 and the decoder circuit 12 are minimized, which reduces power consumption.

<Third Time Series>

A third time series is executed when the time information acquisition operation start time is unpredictable. That is, the time information acquisition operation start time is required to be predicted based on the internal time, but when it is thought that a certain error or more occurs between the internal time and the accurate time depending on the internal time counting accuracy, the predicted time information acquisition operation start time is unreliable. In such a case, it is reasonable to regard the time information acquisition operation start time to be unpredictable. The determination of whether or not the time information acquisition operation start time is unpredictable maybe made based on appropriate conditions. For example, the time information acquisition operation start time may be regarded unpredictable under a state in which an error of ±1 second or more may occur between the internal clock and the accurate time. This condition corresponds to a state in which, when the internal clock accuracy is ±15 seconds per month, reception and adjustment of the time information are not carried out for about 48 hours, or a state in which the time is manually adjusted.

Figure 6A:
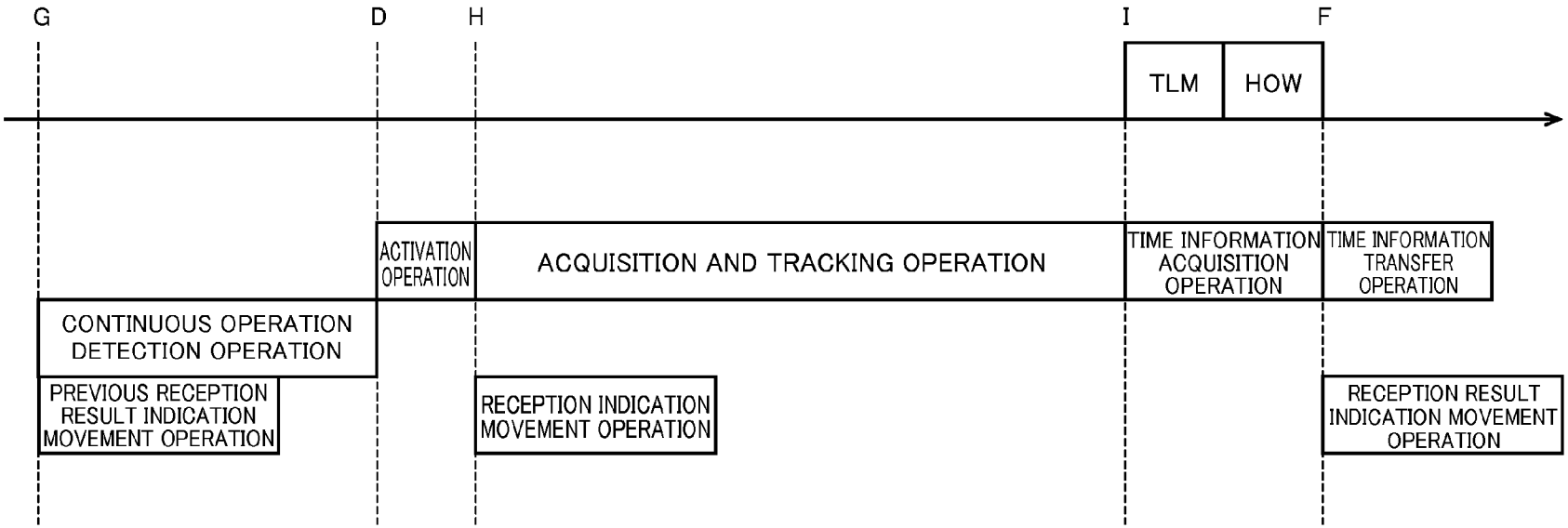
FIG. 6A is a time chart illustrating a third time series.

FIG. 6A is a time chart illustrating the third time series. Also in this chart, the horizontal axis represents the elapse of time. At the time point G at which the push button 4*b* is pressed, the controller 13 immediately starts the previous reception result indication movement operation to cause the analog indication member 7 to indicate the previous reception result. At the time point D at which the continuous operation detection operation is completed, the controller 13 starts the activation operation. Further, at the time point H at which the activation operation is ended, the controller 13 starts the acquisition and tracking operation, and also starts the reception indication movement operation. In this case, the acquisition and tracking operation is continued until an actual time information acquisition operation start time I instead of the predicted timing. Subsequent operations are the same as those in the first time series.

<Fourth Time Series>

A fourth time series is executed when acquisition of WN is necessary. The acquisition of WN may be executed when the clock circuit 15 stops due to the decrease of a power supply voltage of the satellite radio-controlled wristwatch 1, or at a time point at which a predetermined period (for example, 1 month) has elapsed from the previous WN reception.

Figure 6B:
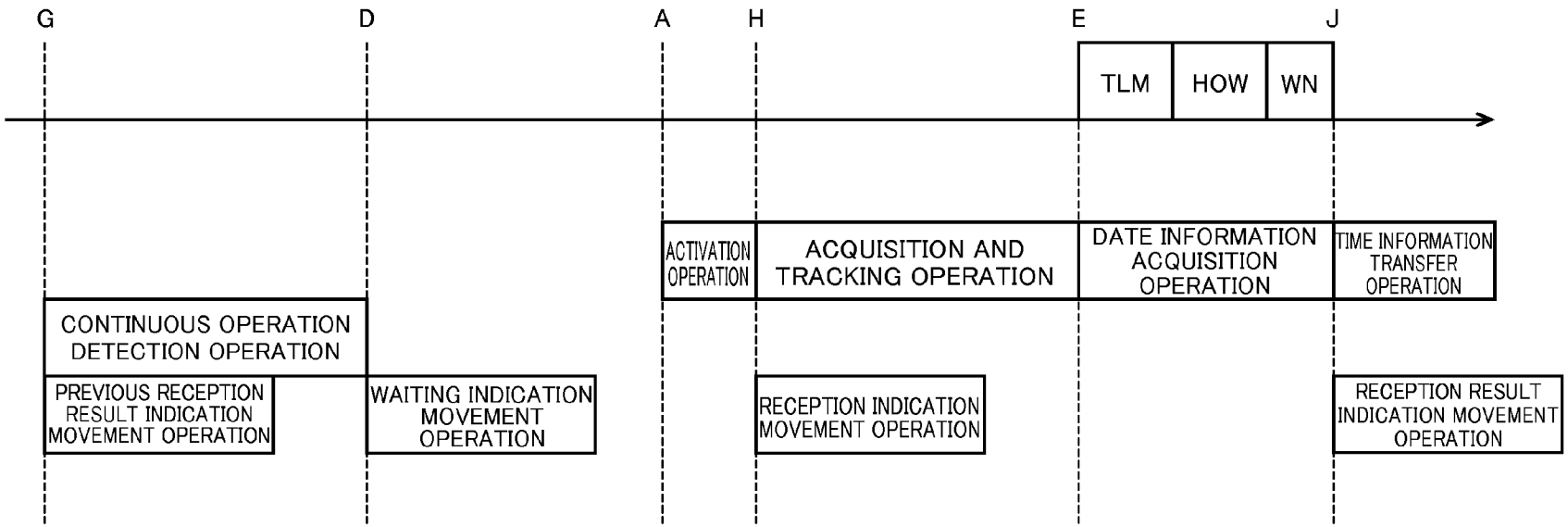
FIG. 6B is a time chart illustrating a fourth time series.

FIG. 6B is a time chart illustrating the fourth time series. Also in this chart, the horizontal axis represents the elapse of time. An operation in the fourth time series is similar to the operation in the previous second time series. At the time point G at which the pushbutton 4*b* is pressed, the controller 13 immediately starts the previous reception result indication movement operation to cause the analog indication member 7 to indicate the previous reception result. Then, at the time point D at which the continuous operation detection operation is completed, the controller 13 starts the waiting indication movement operation. In this embodiment, the second hand starts moving to point the "RDY" indication. During this period, power is not supplied to the satellite radio wave reception unit 14.

Subsequently, the controller 13 waits for the arrival of the activation operation start time A to start the activation operation. Further, at the time point H at which the activation operation is ended, the controller 13 starts the acquisition and tracking operation, and simultaneously starts the reception indication movement operation. Also in this case, the reception indication movement operation and the acquisition and tracking operation are temporally overlapped with each other. Note that, the time point at which the reception indication movement operation is started may be the activation operation start time A instead of the time point H at which the activation operation is ended. Alternatively, the time point at which the reception indication movement operation is ended may be the time point H at which the activation operation is ended. In this case, the time point at which the reception indication movement operation is started is inversely calculated by subtracting the time period required for the reception indication movement operation from the time point H at which the activation operation is ended. After that, the controller 13 starts the date information acquisition operation from the time information acquisition operation start time E to acquire TOW contained in HOW and WN. At a time point J at which the WN acquisition is ended, the controller 13 starts the time information transfer operation, and simultaneously carries out the reception result indication movement operation. With this, time information and information relating to the date are corrected.

Figure 7:
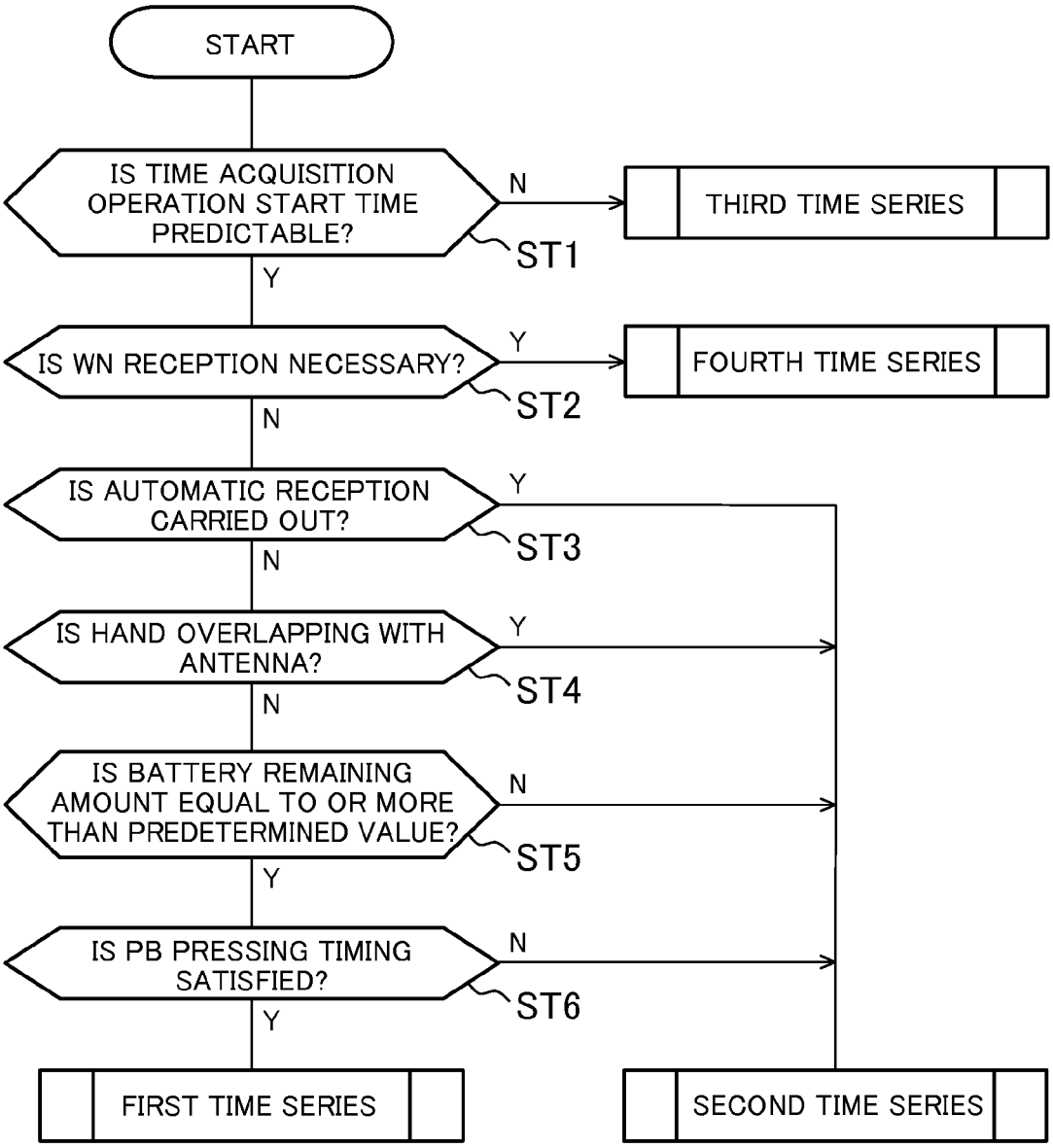
FIG. 7 is a flow chart illustrating an operation relating to reception of the satellite radio-controlled wristwatch according to the first embodiment of the present invention.

FIG. 7 is a flow chart illustrating an operation relating to the reception of the satellite radio-controlled wristwatch 1 of this embodiment.

The controller 13 first determines whether or not the time information acquisition operation start time is predictable (Step ST1). When the time information acquisition operation start time is unpredictable, the reception operation is carried out based on the above-mentioned third time series. Otherwise, subsequently, determination is made on whether or not the reception of WN is necessary (Step ST2). When the reception of WN is necessary, the reception operation is carried out based on the above-mentioned fourth time series.

Otherwise, that is, when only the reception of TOW is required, determination is subsequently made in order on whether or not the automatic reception is carried out (Step ST3), whether or not the hands (such as the hour and minute hands) are located at positions at which the hands affect the reception performance, such as positions overlapping with the antenna 10 in plan view (Step ST4), and whether or not the remaining amount of the battery 17 is equal to or more than a predetermined value (Step ST5). As a result, in all of the cases where the automatic reception is carried out, the hands overlap with the antenna, and the battery remaining amount is not equal to or larger than the predetermined value, the reception operation is carried out based on the second time series.

This flow has the following meaning. That is, as described above, the operation based on the first time series starts the activation operation earlier in the middle of the continuous operation detection operation. When the push button 4*b* is separated before the continuous operation detection operation is completed, the reception operation is stopped, which causes wasteful power consumption. In view of this, in the automatic reception that is carried out without being known by the user, there is little significance to shorten the entire reception operation, and wasteful power consumption is required to be avoided. Further, when the hands overlap with the antenna, the possibility of reception success reduces, and hence wasteful power consumption is required to be avoided as well. Still further, when the battery remaining amount is not equal to or more than the predetermined value, the wasteful power consumption is required to be avoided as well. Therefore, the operation based on the second time series is adopted for all of those cases. Note that, the control of this flow is merely an example, and may be changed as appropriate depending on the product specification.

The controller 13 further determines whether or not the pressing timing of the push button 4*b* is at least a predetermined preceding operation reception time period earlier than the activation operation start time and after a time point that is an operation reception time period earlier than the activation operation start time (Step ST6). When this timing is satisfied, the reception operation is carried out based on the first time series, and otherwise the reception operation is carried out based on the second time series.

Incidentally, referring back to FIG. 1, when the arrangement of the position indications 5 is focused, symbols "OK" and "NG" that are indications representing the reception result, symbol "RDY" indicating the waiting state, and symbol "RX" indicating that the reception is in progress are arranged clockwise in this order. At this time, with reference to the second time series illustrated in FIG. 5B, the operations relating to the analog indication member 7 are executed in the following order: the previous reception result indication movement operation; the waiting indication movement operation; the reception indication movement operation; and the reception result indication movement operation. Also in other time series, although there is a case where the waiting indication movement operation is absent, the order of those operations is the same. This means that the analog indication member 7 changes its position and attitude in the order of first the indication representing the reception result during the reception operation, then the indication representing the waiting state, the indication representing that the reception is in progress, and the indication representing the reception result again. In view of this, when those position indications 5 are arranged in the forward direction (in this case, clockwise) in the order to be pointed by the analog indication member 7, the analog indication member 7 (in this case, the second hand) can point the respective position indications 5 in order in a shortest route by rotating only in the forward direction. In this manner, high-speed indication by the analog indication member 7 is possible, and also the power consumption is minimized.

Figure 8:
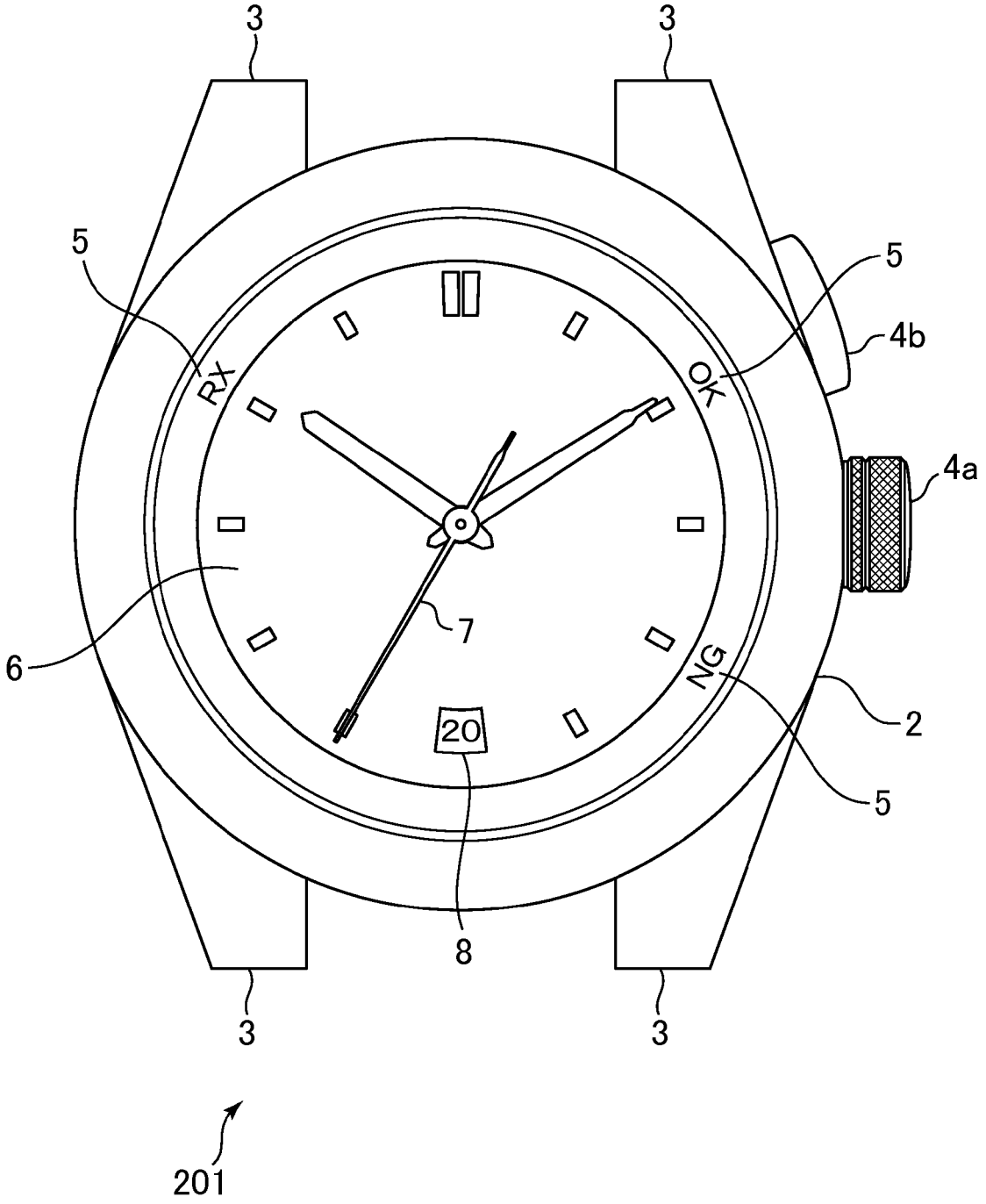
FIG. 8 is a plan view illustrating a satellite radio-controlled wristwatch according to a second embodiment of the present invention.

Subsequently, a satellite radio-controlled wristwatch 201 according to a second embodiment of the present invention is described. FIG. 8 is a plan view illustrating the satellite radio-controlled wristwatch 201 of this embodiment, which differs in appearance from the satellite radio-controlled wristwatch 1 of the previous embodiment illustrated in FIG. 1 in that one of the position indications 5, which indicates the waiting state ("RDY"), is omitted. Other points in appearance are the same as those in the previous embodiment. Note that, parts or members common to those in the previous embodiment are denoted by the same reference symbols, and detailed description thereof is omitted herein.

Further, the functional block diagram of the satellite radio-controlled wristwatch 201 according to this embodiment and the flow chart illustrating the operation relating to the reception of the satellite radio-controlled wristwatch 201 are the same as those of the satellite radio-controlled wristwatch 1 according to the previous embodiment. Therefore, FIG. 2 and FIG. 7 are used as the functional block diagram of the satellite radio-controlled wristwatch 201 according to this embodiment and the flow chart illustrating the operation relating to the reception of the satellite radio-controlled wristwatch 201.

Further, regarding the time series to be executed by the controller 13 of the satellite radio-controlled wristwatch 201 according to this embodiment, the first time series and the third time series are the same as those in the satellite radio-controlled wristwatch 1 according to the previous embodiment (FIG. 5A and FIG. 6A, respectively).

Figure 9A:
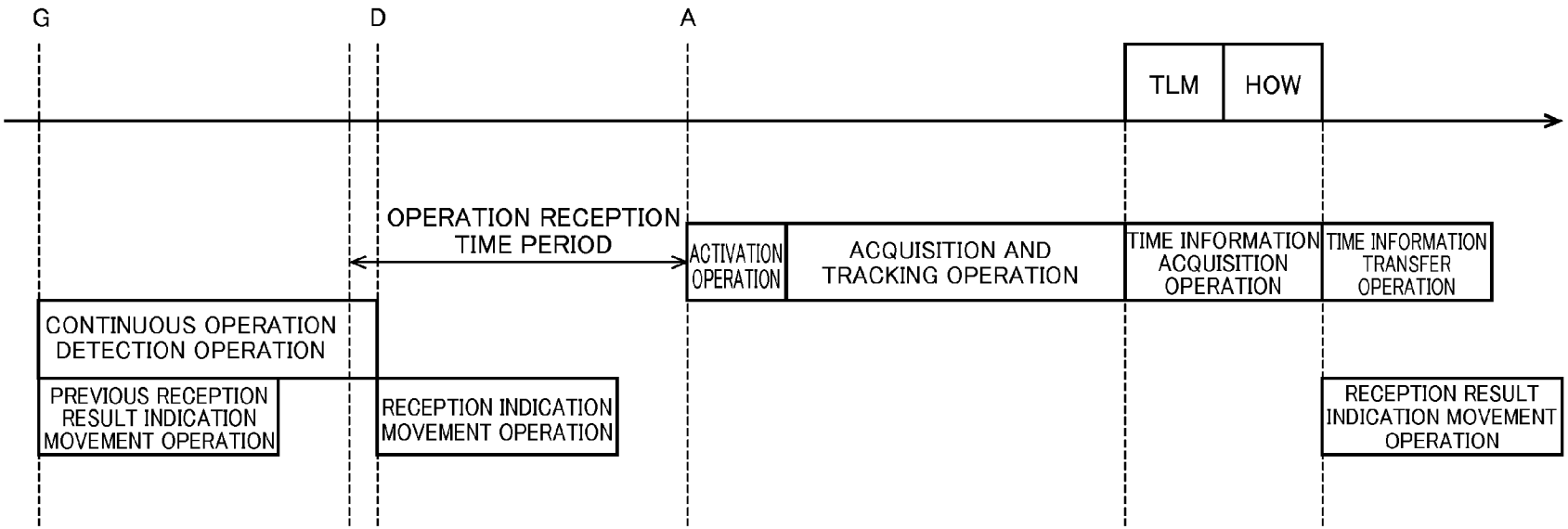
FIG. 9A is a time chart illustrating a second time series.

FIG. 9A is a time chart of the second time series of the satellite radio-controlled wristwatch 201. Also in this chart, the horizontal axis represents the elapse of time. When the pushbutton 4*b* is pressed at the time point G that is at least an operation reception time period earlier than the activation operation start time A that is a time point at which the activation operation is started, the controller 13 immediately starts the previous reception result indication movement operation to cause the analog indication member 7 to indicate the previous reception result.

Then, the controller 13 starts the reception indication movement operation at the time point D. In this embodiment, the second hand starts moving to point the "RX" indication. However, at this time point, power is not supplied to the satellite radio wave reception unit 14 yet.

Subsequently, the controller 13 waits for the arrival of the activation operation start time A to start the activation operation. Further, the controller 13 starts the acquisition and tracking operation immediately after the activation operation is ended. Subsequent operations are similar to those in the first time series.

In the reception operation based on the second time series described above, the power consumption is reduced similarly to the case of the previous embodiment. In addition, although the time for indicating that the reception is in progress is increased because the indication for the waiting state is absent, the position indications 5 are simpler.

Figure 9B:
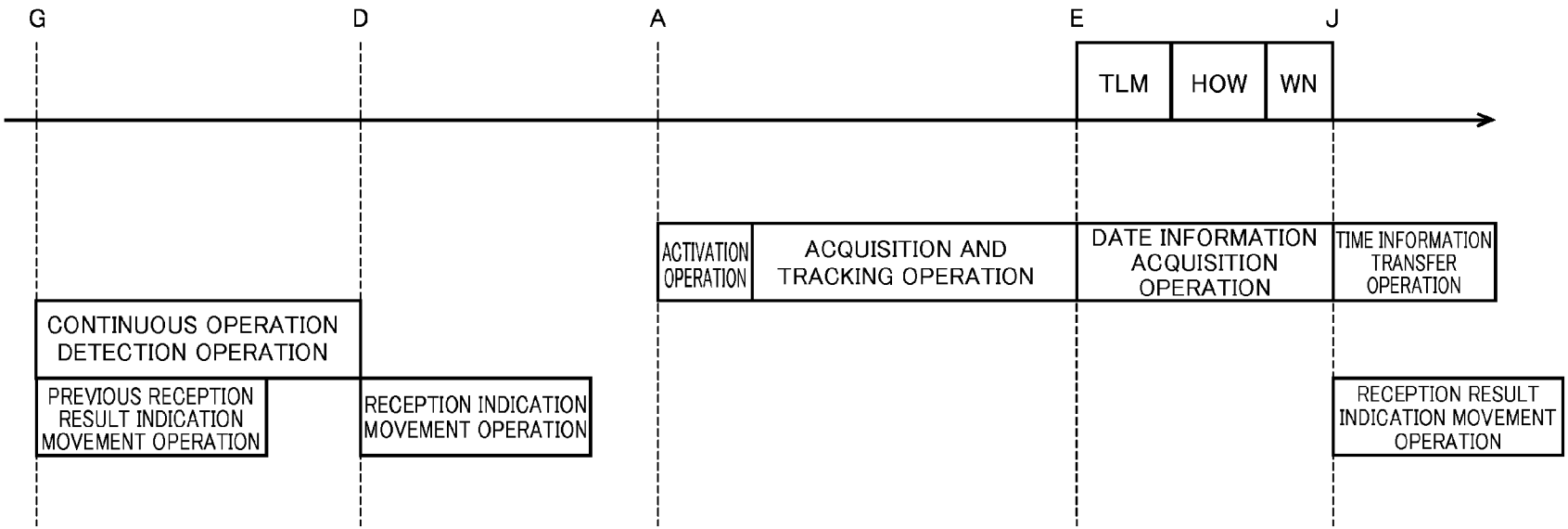
FIG. 9B is a time chart illustrating a fourth time series.

Further, FIG. 9B illustrates a time chart of a fourth time series of the satellite radio-controlled wristwatch 201. Also in this chart, the horizontal axis represents the elapse of time. The controller 13 immediately starts the previous reception result indication movement operation at the time point G at which the push button 4*b* is pressed to cause the analog indication member 7 to indicate the previous reception result. Then, at the time point D at which the continuous operation detection operation is completed, the controller 13 starts the reception indication movement operation. In this embodiment, the secondhand starts moving to point the "RX" indication. However, at this time point, power is not supplied to the satellite radio wave reception unit 14 yet.

Subsequently, the controller 13 waits for the arrival of the activation operation start time A to start the activation operation. Further, immediately after the activation operation is ended, the controller 13 starts the acquisition and tracking operation. After that, the controller 13 starts the date information acquisition operation from the time information acquisition operation start time E to acquire TOW contained in HOW and WN. At the time point J at which the WN acquisition is ended, the controller 13 starts the time information transfer operation, and simultaneously carries out the reception result indication movement operation. With this, the time information and the information relating to the date are corrected.

Figure 10:
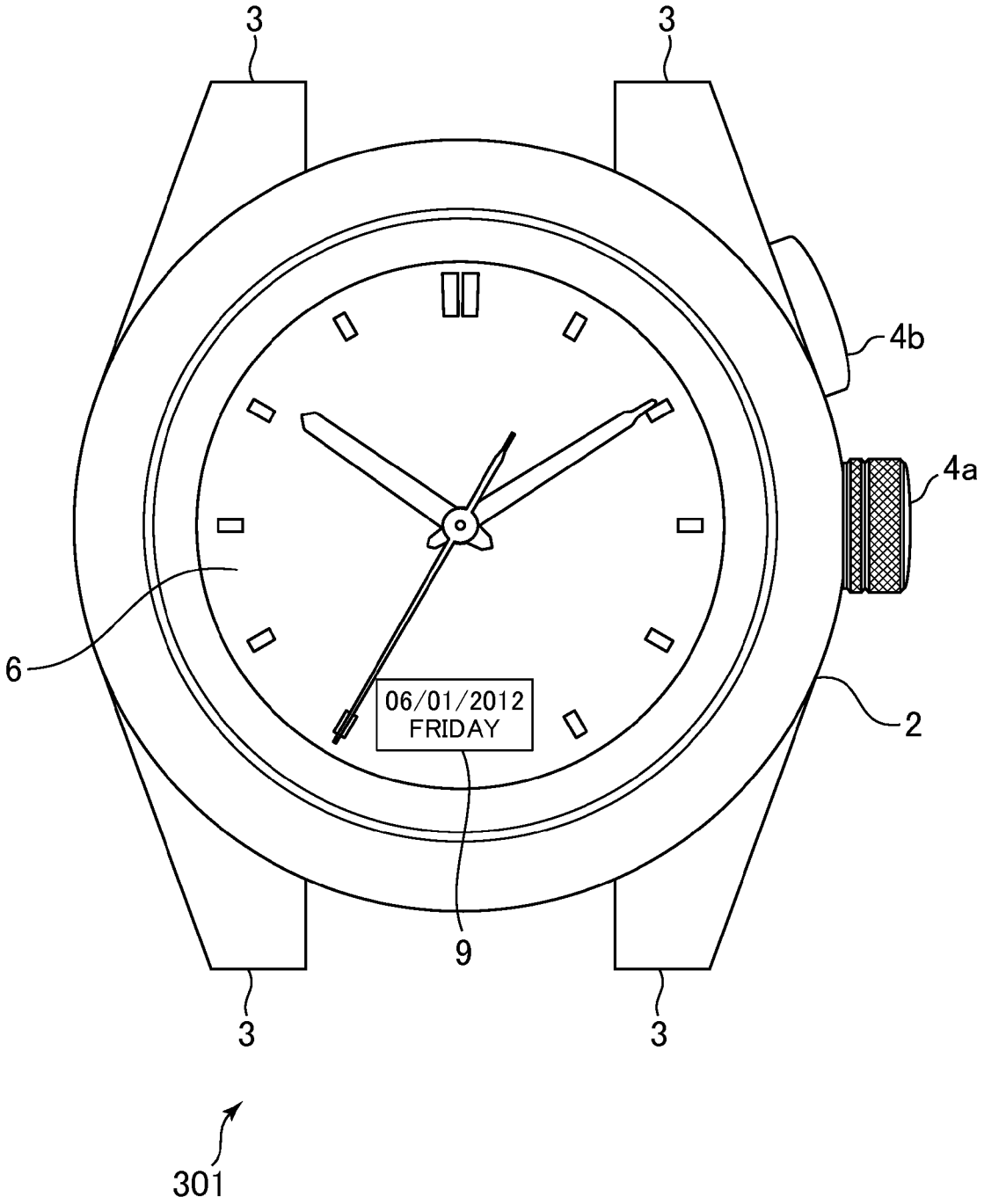
FIG. 10 is a plan view illustrating a satellite radio-controlled wristwatch according to a third embodiment of the present invention.

Subsequently, a satellite radio-controlled wristwatch 301 according to a third embodiment of the present invention is described. FIG. 10 is a plan view illustrating the satellite radio-controlled wristwatch 301 of this embodiment, which differs in appearance from the satellite radio-controlled wristwatch 1 of the first embodiment illustrated in FIG. 1 in that the position indications 5 (see FIG. 1) are not provided, and that a digital display unit 9 is provided instead of the date window 8 (see FIG. 1) . Other points in appearance are the same as those in the first embodiment. Note that, parts or members common to those in the first embodiment are denoted by the same reference symbols, and detailed description thereof is omitted herein.

The digital display unit 9 is a display device capable of arbitrarily changing the display contents, such as a liquid crystal display device. The digital display unit 9 generally displays information such as the date and the day of the week as illustrated in FIG. 10, and further displays various reception states during the reception operation of the satellite radio-controlled wristwatch 301. Therefore, the satellite radio-controlled wristwatch 301 does not include the analog indication member 7 (see FIG. 1).

Further, the functional block diagram of the satellite radio-controlled wristwatch 301 according to this embodiment and the flowchart illustrating the operation relating to the reception of the satellite radio-controlled wristwatch 301 are the same as those of the satellite radio-controlled wristwatch 1 according to the previous embodiment. Therefore, FIG. 2 and FIG. 7 are used as the functional block diagram of the satellite radio-controlled wristwatch 301 according to this embodiment and the flow chart illustrating the operation relating to the reception of the satellite radio-controlled wristwatch 301.

The digital display unit 9 used in the satellite radio-controlled wristwatch 301 has a feature in that, unlike the analog indication member 7 (see FIG. 1), its display instantaneously completes. Therefore, in the time series executed by the controller 13 of the satellite radio-controlled wristwatch 301, the operation of moving the analog indication member 7 (see FIG. 1) for carrying out specific indication is unnecessary, and the digital display unit 9 is operated to immediately achieve the desired display.

Figure 11:
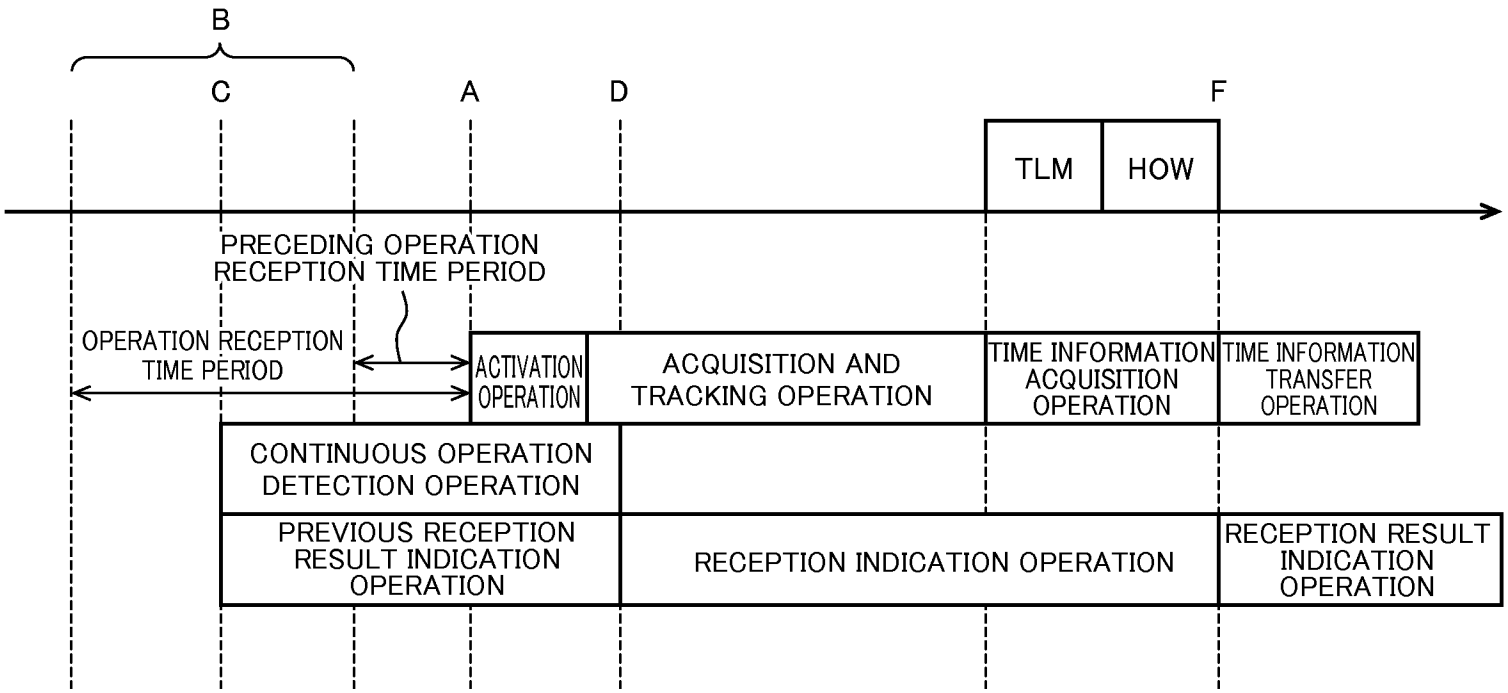
FIG. 11 is a time chart illustrating a first time series.

FIG. 11 is a time chart of a first time series executed by the satellite radio-controlled wristwatch 301 as an example of such a time series. Also in this chart, the horizontal axis represents the elapse of time. When the push button 4*b* is pressed at the time point C during the period B that is at least a preceding operation reception time period earlier than the activation operation start time A that is a time point at which the activation operation is started and after a time point that is an operation reception time period earlier than the activation operation start time A, the controller 13 immediately starts a previous reception result indication operation to cause the digital display unit 9 to display the previous reception result. This previous reception result indication operation is continued until the time point D at which the continuous operation detection operation is completed. The controller 13 then immediately starts a reception indication operation to cause the digital display unit 9 to display that the reception is in progress. Further, the controller 13 starts the acquisition and tracking operation immediately after the activation operation is ended, and after that, starts the time information acquisition operation from the time information acquisition operation start time E. The reception indication operation is continued until the time point F at which the time information acquisition operation is ended. At the time point F, the time information transfer operation is started. Simultaneously, a reception result indication operation is started so that the controller 13 causes the digital display unit 9 to display the reception result. This reception result indication operation is continued for a predetermined time period as appropriate.

In the reception operation based on the first time series described above, the time information transfer operation and the reception result indication operation are executed so as to be temporally overlapped with each other, and the reception result is displayed without waiting for the completion of the transfer of the time information. Therefore, the time required for the entire reception operation is reduced, and the processing ranging from the user's operation through the reception operation to the completion of the time adjustment is rapidly accomplished. This point is also similar in the second time series, the third time series, and the fourth time series of the satellite radio-controlled wristwatch 301.

Note that, each of the embodiments described above is merely an example for carrying out the invention, and the present invention is not limited to the specific shapes, arrangement, and configuration described in each of the embodiments. In particular, the arrangement, numbers, and designs of various members are matters to be appropriately designed by the person skilled in the art as necessary.

The invention claimed is:

1. A satellite radio-controlled wristwatch, comprising:

a satellite radio wave reception unit comprising an antenna for receiving a satellite radio wave, a high frequency circuit, and a decoder circuit;

an analog indication member for indicating at least that a reception operation is in process, and for indicating a reception result;

a clock circuit for holding and counting an internal time;

an operating member for receiving an operation of a user; and a controller for controlling timing of at least:

an activation operation of supplying power to the satellite radio wave reception unit for activation thereof;

an acquisition and tracking operation of acquiring and tracking a certain satellite radio wave by the satellite radio wave reception unit;

a time information acquisition operation of acquiring time information from the satellite radio wave received by the satellite radio wave reception unit;

a detection operation which detects if the operating member is operated continuously for a predetermined operation reception time period; and a reception indication movement operation of moving the analog indication member to a position indicating that the reception operation is in progress, the controller being configured to carry out such control that the reception indication movement operation overlaps with the acquisition and tracking operation, wherein the controller starts the activation operation during the continuous operation detection operation after the detection operation is started.

2. The satellite radio-controlled wristwatch according to claim 1, wherein the controller starts the reception indication movement operation immediately after the detection operation is ended, and starts the acquisition and tracking operation immediately after the activation operation is ended.

3. The satellite radio-controlled wristwatch according to claim 1, wherein the controller further controls timing of:

a time information transfer operation of transferring the acquired time information from the satellite radio wave reception unit to the clock circuit; and a reception result indication movement operation of moving the analog indication member to a position indicating the reception result, and wherein the controller carries out such control that the time information transfer operation overlaps with the reception result indication movement operation.

4. A satellite radio-controlled wristwatch, comprising:

a satellite radio wave reception unit comprising an antenna for receiving a satellite radio wave, a high frequency circuit, and a decoder circuit;

an analog indication member for indicating at least that a reception operation is in process, and for indicating a reception result;

a clock circuit for holding and counting an internal time;

an operating member for receiving an operation of a user; and a controller for controlling timing of at least:

an activation operation of supplying power to the satellite radio wave reception unit for activation thereof;

an acquisition and tracking operation of acquiring and tracking a certain satellite radio wave by the satellite radio wave reception unit a time information acquisition operation of acquiring time information from the satellite radio wave received by the satellite radio wave reception unit;

a detection operation which detects if the operating member is operated continuously for a predetermined operation reception time period, and a reception indication movement operation of moving the analog indication member to a position indicating that the reception operation is in progress, the controller being configured to carry out such control that the reception indication movement operation overlaps with the acquisition and tracking operation, wherein the controller waits for arrival of the activation operation start time to start the activation operation when the operating member is operated for at least the predetermined operation reception time period earlier than an activation operation start time that is a time point at which the activation operation is started, wherein the activation operation start time is inversely calculated from a time information acquisition operation start time that is a time point at which the time information acquisition operation is started, the time information acquisition operation start time being predicted based on the internal time, after the detection operation is ended.

5. The satellite radio-controlled wristwatch according to claim 4, wherein the controller starts the reception indication movement operation immediately after the detection operation is ended.

6. The satellite radio-controlled wristwatch according to claim 4, wherein the controller further controls a timing of a waiting indication movement operation of moving the analog indication member to a position indicating a waiting state, and wherein the controller starts the waiting indication movement operation immediately after the detection operation is ended, and then starts the reception indication movement operation.

7. A satellite radio-controlled wristwatch, comprising:

a satellite radio wave reception unit comprising an antenna for receiving a satellite radio wave, a high frequency circuit, and a decoder circuit;

an analog indication member for indicating at least that a reception operation is in process, and for indicating a reception result;

a clock circuit for holding and counting an internal time;

an operating member for receiving an operation of a user; and a controller for controlling timing of at least:

an activation operation of supplying power to the satellite radio wave reception unit for activation thereof;

an acquisition and tracking operation of acquiring and tracking a certain satellite radio wave by the satellite radio wave reception unit;

a time information acquisition operation of acquiring time information from the satellite radio wave received by the satellite radio wave reception unit;

a detection operation which detects if the operating member is operated continuously for a predetermined operation reception time period; and a reception indication movement operation of moving the analog indication member to a position indicating that the reception operation is in progress, the controller being configured to carry out such control that the reception indication movement operation overlaps with the acquisition and tracking operation, wherein the controller further controls a timing of a date information acquisition operation of acquiring, from the satellite radio wave received by the satellite radio wave reception unit, date information that is information relating to date, and wherein, when the date information is to be acquired, the controller starts the activation operation after waiting for arrival of an activation operation start time that is a time point at which the activation operation is started, which is inversely calculated from a date information acquisition operation start time that is a time point at which the date information acquisition operation is started, the date information acquisition operation start time being predicted based on the internal time.

8. A satellite radio-controlled wristwatch, comprising:

a satellite radio wave reception unit comprising an antenna for receiving a satellite radio wave, a high frequency circuit, and a decoder circuit;

an indication member for indicating at least a reception result;

a clock circuit for holding and counting an internal time; and a controller for controlling timings of at least:

a time information acquisition operation of acquiring time information from the satellite radio wave received by the satellite radio wave reception unit;

a time information transfer operation of transferring the acquired time information from the satellite radio wave reception unit to the clock circuit; and a reception result indication operation of causing the indication member to indicate the reception result, the controller being configured to carry out such control that the time information transfer operation overlaps with the reception result indication operation, and that the time information acquisition operation does not overlap with the reception result indication operation.

* * * * *